US007467440B2

(12) United States Patent
Seidler

(10) Patent No.: US 7,467,440 B2
(45) Date of Patent: Dec. 23, 2008

(54) VIRTUAL HINGE

(75) Inventor: David Seidler, New York, NY (US)

(73) Assignee: L'Oreal USA, Inc., New York, NY (US)

( * ) Notice: Subject to any disclaimer, the term of this patent is extended or adjusted under 35 U.S.C. 154(b) by 75 days.

(21) Appl. No.: 11/174,598

(22) Filed: Jul. 6, 2005

(65) Prior Publication Data

US 2005/0268433 A1 Dec. 8, 2005

Related U.S. Application Data

(62) Division of application No. 09/933,992, filed on Aug. 21, 2001, now Pat. No. 7,089,627.

(51) Int. Cl.
*E05D 11/10* (2006.01)

(52) U.S. Cl. ..... 16/320

(58) Field of Classification Search ..... 16/320, 16/254, 260; 206/542, 818, 823; 220/810, 220/845, 230, 4.21, 4.22, 4.24; 132/294, 132/295

See application file for complete search history.

(56) References Cited

U.S. PATENT DOCUMENTS

| | | | |
|---|---|---|---|
| 94,000 | A | 8/1869 | Jones |
| 1,126,217 | A | 1/1915 | Hough |
| 1,463,259 | A | 7/1923 | Flagg |
| 1,688,042 | A | 10/1928 | Gaess |
| 1,692,300 | A | 11/1928 | Heitel et al. |
| 1,760,015 | A | 5/1930 | Schwabe |
| 1,950,465 | A | 3/1934 | Whitlock |
| 1,987,533 | A | 1/1935 | Kreisler |
| 2,003,355 | A | 6/1935 | Farkas |
| 2,302,661 | A | 11/1942 | Benson |
| 2,327,513 | A | 8/1943 | Esterow |
| 2,461,711 | A | 2/1949 | Wewetzer |
| 2,624,908 | A | 1/1953 | Irelan |
| 2,742,665 | A | 4/1956 | Stopek |
| 2,791,346 | A | 5/1957 | Tell |
| 3,152,716 | A | 10/1964 | Feldhahn |
| 3,188,157 | A | 6/1965 | Rand |
| 3,264,678 | A | 8/1966 | Parmelee |
| 3,277,681 | A | 10/1966 | Bey |

(Continued)

FOREIGN PATENT DOCUMENTS

| | | |
|---|---|---|
| DE | 861 817 | 1/1953 |

(Continued)

OTHER PUBLICATIONS

Office Action dated Aug. 1, 2007, for U.S. Appl. No. 10/728,984.

(Continued)

*Primary Examiner*—Chuck Y. Mah
(74) *Attorney, Agent, or Firm*—Finnegan, Henderson, Farabow, Garrett & Dunner, LLP

(57) ABSTRACT

A magnetic or virtual hinge defining a virtual hinge axis includes first and second plates of non-magnetic material, and first and second magnets disposed in the respective plates adjacent the hinge axis for movement therewith. The first and second members are movable about the hinge axis between closed and open orientations.

66 Claims, 8 Drawing Sheets

U.S. PATENT DOCUMENTS 3,334,714 A 8/1967 Gordon
3,370,305 A 2/1968 Goott et al.
3,372,443 A 3/1968 Daddona, Jr.
3,388,418 A 6/1968 Bey
3,392,820 A 7/1968 Azim
3,392,868 A 7/1968 Pfrommer
3,441,033 A 4/1969 Flax
3,476,123 A 11/1969 Flax
3,477,091 A 11/1969 Gordon
3,498,471 A 3/1970 Dirkx
3,592,354 A 7/1971 Nielsen
3,663,990 A 5/1972 Shane
3,674,039 A 7/1972 Vastano
3,707,017 A 12/1972 Paquette
3,907,410 A 9/1975 Richmond et al.
3,961,721 A 6/1976 Gordon et al.
4,041,571 A 8/1977 Blevins
4,089,467 A 5/1978 Makowicki
4,239,308 A 12/1980 Bradley
4,308,972 A 1/1982 McReynolds et al.
4,315,345 A 2/1982 Schijf
4,343,397 A 8/1982 Nozawa et al.
4,345,697 A 8/1982 Wilson et al.
4,384,375 A 5/1983 Gerome
4,452,373 A 6/1984 Pearce et al.
4,513,974 A 4/1985 Lin
4,560,078 A 12/1985 Dubuisson
4,595,115 A 6/1986 Huynh
4,596,329 A 6/1986 Eldridge, Jr.
4,684,017 A 8/1987 Watanabe et al.
4,807,773 A 2/1989 Tsai
4,815,483 A 3/1989 DuGrenier et al.
4,821,751 A * 4/1989 Chen ..... 132/295
4,858,454 A 8/1989 McAnulty, III
4,880,139 A 11/1989 Jumel et al.
4,942,271 A 7/1990 Corsi et al.
4,951,968 A 8/1990 Adams
4,984,706 A 1/1991 Cadwell et al.
5,005,697 A 4/1991 Jimbo et al.
5,036,997 A 8/1991 May et al.
5,099,659 A 3/1992 Carranza et al.
D328,817 S 8/1992 Holland
5,135,012 A 8/1992 Kamen et al.
5,161,556 A 11/1992 Audebourg et al.
5,210,906 A 5/1993 Aihara et al.
5,246,020 A 9/1993 Wu
5,312,144 A 5/1994 Yoshida et al.
5,405,004 A 4/1995 Vest et al.
D370,307 S * 5/1996 Chen ..... D28/79
5,530,992 A 7/1996 Baermann
5,534,663 A 7/1996 Rivers et al.
5,568,820 A 10/1996 Dirksing
5,632,394 A 5/1997 Mecca et al.
5,638,838 A 6/1997 Lombardi
5,638,839 A 6/1997 Montoli
5,657,894 A 8/1997 Bowen
5,704,378 A 1/1998 Machelett
5,740,906 A 4/1998 Lai
5,799,787 A 9/1998 Talbot
5,829,622 A 11/1998 Neuman
5,878,878 A 3/1999 Wu
5,893,481 A 4/1999 Favre
5,953,771 A 9/1999 VanHuss
6,017,220 A 1/2000 Snelson
6,035,865 A 3/2000 Krieger
6,041,935 A * 3/2000 Yang ..... 206/581
6,070,749 A 6/2000 Joulia
6,129,088 A 10/2000 Favre
6,129,089 A * 10/2000 Yuhara ..... 132/300
6,138,686 A 10/2000 Yuhara
6,145,515 A 11/2000 Wu
6,196,232 B1 3/2001 Chkadua
6,217,170 B1 4/2001 Hsiao
6,223,921 B1 5/2001 Huang
6,245,006 B1 6/2001 Olson
6,264,199 B1 7/2001 Schaedel
6,283,298 B1 9/2001 Seidler
6,286,521 B1 9/2001 Joulia
6,302,120 B1 10/2001 Kuo
6,321,925 B1 11/2001 Crouse et al.
6,354,308 B1 3/2002 Kuk
6,378,533 B1 * 4/2002 Roman ..... 132/295
6,408,161 B1 6/2002 Minowa et al.
6,484,731 B1 11/2002 Lacout
6,513,196 B2 2/2003 Snowden et al.
6,532,970 B2 * 3/2003 Phue ..... 132/296
6,553,626 B2 4/2003 Coburn
6,831,541 B1 12/2004 Seidler
6,857,432 B2 * 2/2005 de Laforcade ..... 132/294
2001/0022185 A1 9/2001 Yuhara
2002/0014493 A1 2/2002 Delmon
2002/0096448 A1 * 7/2002 Lee ..... 206/459.1
2002/0147026 A1 10/2002 Hsieh
2002/0153376 A1 10/2002 Seidler
2002/0157684 A1 10/2002 Sebban
2002/0189631 A1 12/2002 Phue
2003/0167599 A1 9/2003 Seidler
2004/0134030 A1 7/2004 Seidler
2004/0134037 A1 7/2004 Seidler

FOREIGN PATENT DOCUMENTS

DE 19036 4/1956
EP 0 178 504 4/1986
EP 0 928 748 7/1999
GB 293545 7/1928
GB 382 471 10/1932
GB 2199807 7/1988
GB 2 264 975 9/1993
JP 408242934 9/1996
JP 409051815 2/1997
JP 10108724 A * 4/1998
JP 10304927 A * 11/1998
WO WO 86/00600 1/1986
WO WO 90/15215 12/1990

OTHER PUBLICATIONS

English language abstract for EP 0 928 748.
English language abstract for JP 408242934.
English language abstract for JP 409051815.
English language abstract for EP 0 178 504.
Response to Office Action dated Jan. 11, 2007, filed May 7, 2007; Office Action dated Jan. 11, 2007; Response to Office Action dated Jul. 13, 2006, filed Oct. 13, 2006; Office Action dated Jul. 13, 2006; for U.S. Appl. No. 10/728,984.

* cited by examiner

FIG. 6
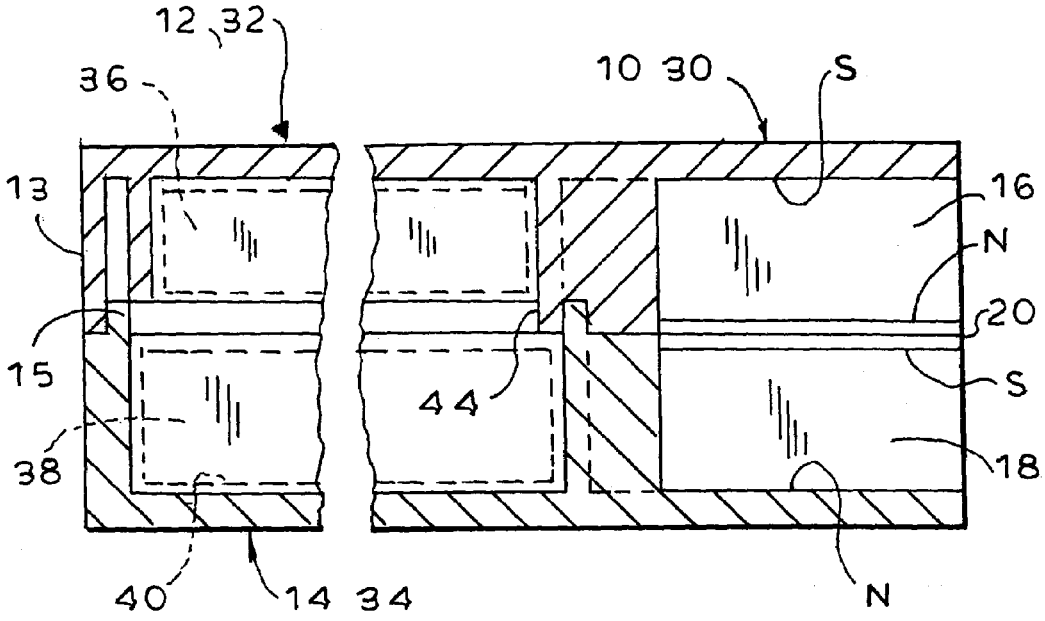
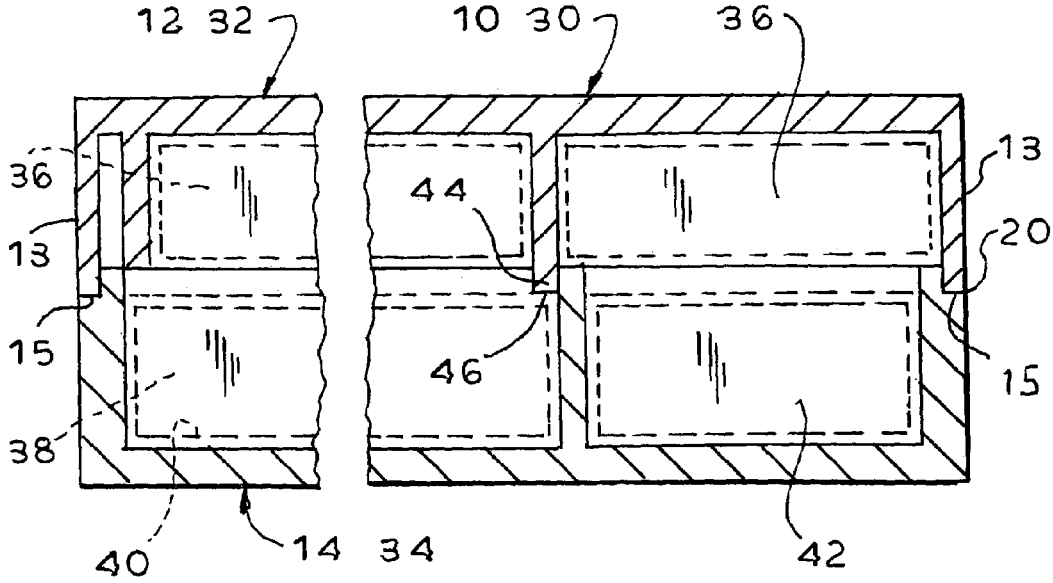
FIG. 8

VIRTUAL HINGE

CROSS REFERENCE TO RELATED APPLICATIONS

This is a division of U.S. application Ser. No. 09/933,992, filed Aug. 21, 2001 now U.S. Pat. No. 7,089,627, the subject matter of which is incorporated herein by reference.

BACKGROUND OF THE INVENTION

The present invention relates to a virtual hinge, and more particularly to a magnetic hinge having a virtual hinge axis.

A conventional physical hinge consists of a pair of hinge plates pivotably secured together by a hinge pin enabling movement of the hinge plates between first and second orientations relative to one another. For ease of reference, the first and second orientations are commonly referred to as "closed" and "open" orientations. In the closed orientation the first and second plates are generally parallel and at least partially overlapping, while in the open orientation the first and second plates are generally parallel and at least partially non-overlapping or (that is, the plates have been moved 180° relative to one another) or the plates are non-parallel (whether at right angles or non-right angles) relative to one another. While the conventional physical hinges typically perform well in a variety of different environments, they have not proven to be entirely satisfactory in particular environments for one or more of the following reasons:

1. The conventional physical hinge is either internally or externally hinged. When two structural components are externally hinged, the overall dimensions of the structural components (e.g., the hinge plates) must be increased to incorporate the physical hinge pin and also so that at least one edge of each structural component is at least partially wrapped around the common hinge pin; this is disadvantageous as it increases the size of the structure formed by the structural components. Where the hinge is internal (that is, disposed between the structural components when the hinge is in the closed orientation), some of the space between the structural components in the closed orientation must be sacrificed to allow for the volume occupied by the physical hinge pin. In other words, the conventional physical hinge either limits the compactness of the structure employing it or requires the a portion of the otherwise useable space within a structure be dedicated to the hinge pin.

2. The conventional physical hinge is not readily deconstructed—that is, in order to separate the hinge plates from one another, typically either the hinge pin must first be removed from the hinge or the edge portion of at least one of the hinge plates which at least partially wraps around the hinge pin must be stretched, broken or the like to enable its separation from the hinge pin. This is frequently an arduous and difficult operation, often as arduous and difficult as the reconstruction or reconstitution of the hinge subsequently when the same is desired. Thus the conventional physical hinge has hinge plates which are neither readily manually separable from one another nor readily manually joinable together (with the hinge pin), as desired.

3. The conventional mechanical hinge is by its nature neither monostable nor bistable—that is, it favors positioning of the hinge plates in neither the closed nor open orientations, as opposed to any of the intermediate orientations. While in many applications it is preferred that the hinge remain with the hinge plates in whatever orientation they were last left by the user, in other applications it is preferred that the hinge be biased to assume an open orientation, a closed orientation or either orientation. (The "open" orientation may be with the hinge plates either transverse to one another (that is, at 90° to one another) or parallel and substantially non-overlapping (that is, at 180° to one another)). It is typically necessary for the conventional mechanical hinge to employ a biasing element (or gravity) acting on at least one of the hinge plates if the hinge is to be monostable, (i.e., biased to a preferred orientation) or bistable (i.e., biased to one of two preferred orientations as opposed to an intermediate orientation therebetween).

4. The conventional physical hinge has a single constant pivot axis aligned with the physical hinge pin. For particular applications it may be preferred to have a hinge with a floating hinge axis—that is, a hinge axis which moves from one position to another as the plates move between the open and closed orientations.

Accordingly, it is an object of the present invention to provide a magnetic or virtual hinge characterized by a virtual hinge axis.

Another object is to provide such a hinge wherein in one preferred embodiment there is no hinge pin either to increase the physical dimensions of the hinge or occupy space intermediate the hinge plates.

A further object is to provide such a hinge wherein in one preferred embodiment the hinge plates are readily manually separable to deconstruct the hinge and readily manually joinable to reconstitute the hinge.

It is also an object of the present invention to provide such a hinge wherein in one preferred embodiment the hinge is monostable or bistable.

It is another object to provide such a hinge wherein in one preferred embodiment the hinge axis relocates as the hinge plates move between the closed and open orientations.

It is a further object to provide various devices which may profitably incorporate such a hinge.

SUMMARY OF THE INVENTION

It has now been found that the above and related objects of the present invention are obtained in a virtual or magnetic hinge having a virtual hinge axis. The hinge is devoid of a physical hinge pin. The hinge comprises a first hinge plate of non-magnetic material, at least one first magnet disposed in the first plate adjacent the hinge axis for movement therewith, a second hinge plate of non-magnetic material, and at least one second magnet disposed in the second plate adjacent the hinge axis for movement therewith. The first and second plates are movable about the hinge axis between a closed orientation and an open orientation. In the closed orientation the first and second plates are generally parallel and at least partially overlapping, and the first and second magnets are generally parallel, overlapping and in the same magnetic orientation. In the open orientation the first and second plates are generally parallel and at least partially non-overlapping, and the first and second magnets are generally parallel, non-overlapping and in the opposite magnetic orientations, the first and second magnets also being coplanar and aligned along a common axis.

In one preferred embodiment, the first plate and the at least one first magnet are readily manually separable from the second plate and the at least one second magnet to deconstruct the hinge. The first plate and the at least one first magnet are preferably more readily manually separable from the second plate and the at least one second magnet to deconstruct the hinge when the plates are in the open orientation than when the plates are in the closed orientation. The first plate and the at least one first magnet are readily manually joinable with the second plate and the at least one second magnet to reconstitute the hinge.

In another preferred embodiment, in the open orientation, the first and second plates are disposed in a common plane, and the first and second magnets are closely adjacent in the common plane. In the closed orientation, the first and second plates are disposed in two parallel planes, and the first and second magnets are closely adjacent and superposed in the two parallel planes.

In a further preferred embodiment, the first and second plates are pivotable about the hinge axis between the closed and open orientations. The hinge axis is either stationary during pivoting of the plates or relocated during pivoting of the plates. The hinge is devoid of a physical hinge pin.

In yet another preferred embodiment, the hinge is bistable and characterized by a lack of stability when the plates are intermediate the closed and open orientations. In this case, the first and second magnets present a right angle adjacent the hinge axis. Alternatively, the hinge is not bistable. In this case, the first and second magnets present a smooth curve adjacent the hinge axis.

At least one of the first and second plates preferably incorporates means to preclude relative sliding movement thereof parallel or transverse to the hinge axis. The hinge axis may extend tangentially and/or intermediate to the peripheries of the first and second plates in both the closed and open orientations.

Optionally, the first plate has disposed therein at least a spaced apart pair of first magnets and the second plate has disposed therein at least a spaced apart pair of second magnets. In the closed orientation, each of the first magnets is generally parallel to and overlapping a respective one of the second magnets, and in the same magnetic orientation with respect thereto. In the open orientation, each of the first magnets is generally parallel to and non-overlapping a respective one of the second magnets and in aligned but opposite magnetic orientations with respect thereto.

Preferably, the first and second magnets are in essentially immediate physical contact in both the open and closed orientations.

As the hinge pin is virtual, the virtual hinge axis neither increases the physical dimensions of the hinge nor physically occupies space intermediate the plates.

The present invention further encompasses a cosmetic case incorporating the hinge, the first plate defining a base of the case and the second plate defining a cover of the case, the base and cover being movable between said closed and open orientations.

BRIEF DESCRIPTION OF THE DRAWING

The above and related objections, features and advantages of the present invention will be more fully understood by reference to the following detailed description of the presently preferred, albeit illustrative, embodiments of the present invention when taken in conjunction with the accompanying drawing wherein:

FIGS. 6 and 7 are sectional views thereof, taken along the lines of 6-6 of FIG. 3 and 7-7 of FIG. 5;

FIG. 8 is a sectional view thereof taken along the line of 8-8 of FIG. 3 with one plate being illustrated in phantom line in an intermediate orientation;

DETAILED DESCRIPTION OF THE PREFERRED EMBODIMENTS

Figure 1:
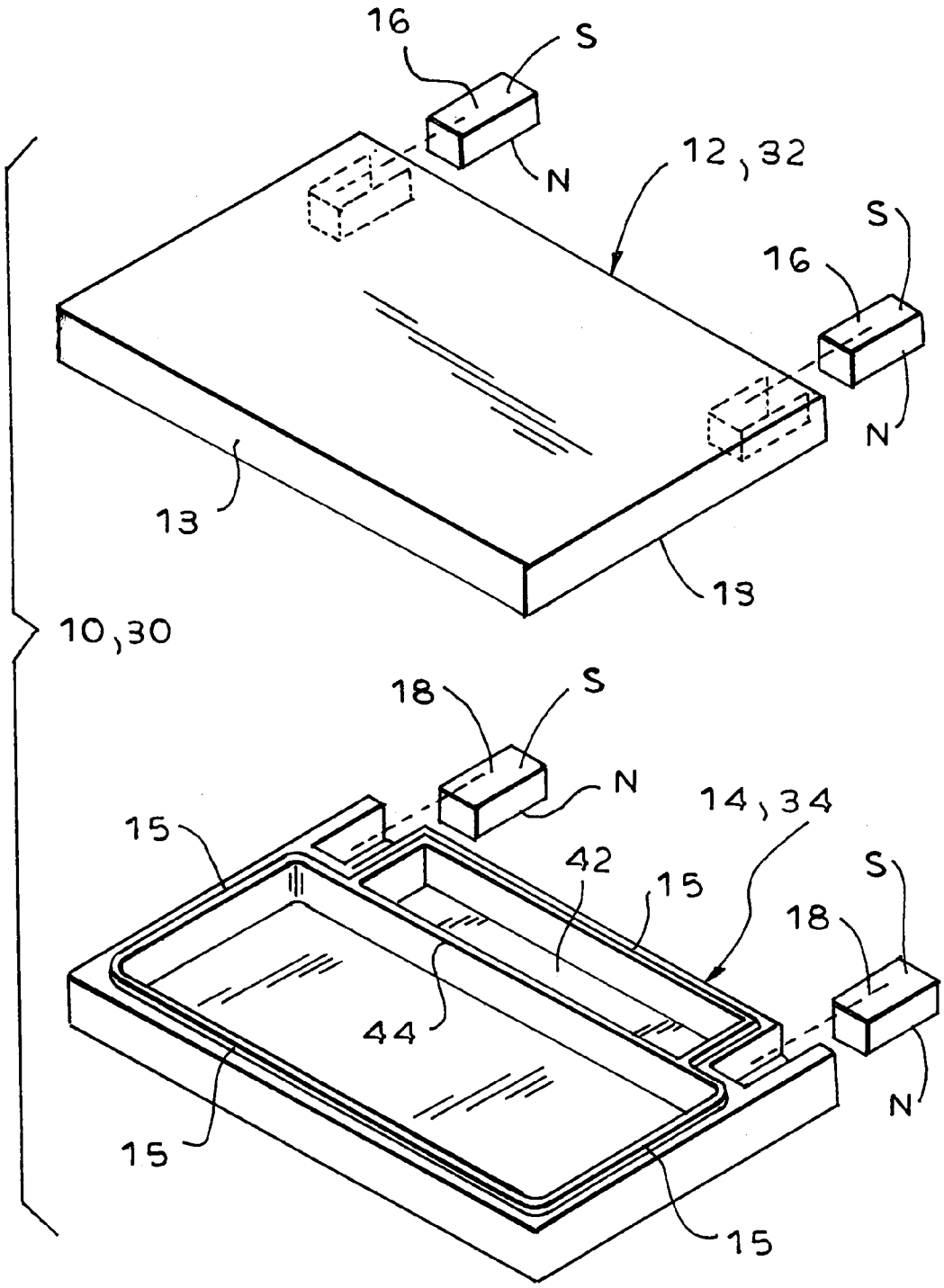
FIG. 1 is an exploded isometric view of a two plate hinge according to the present invention in the closed orientation.

Consonant with the description of a conventional mechanical hinge as consisting of two hinge plates and a hinge pin pivotally connecting the hinge plates, the following description employs the term "hinge plate" or "plate." However, it should be appreciated that, as in the conventional physical hinge, the "plate" need not be flat or thin (as might be suggested by use of the term "plate"), but may alternatively be possessed of an uneven non-flat surface and a thick or irregular non-thin configuration.

Referring now to the drawing, and in particular to FIGS. 1-8 thereof, therein illustrated is a first embodiment of a hinge according to the present invention, generally designated by the reference numeral 10.

As best seen in the exploded view of FIG. 1, the hinge 10 comprises a first hinge plate, generally designated 12, and a second hinge plate, generally designated 14, both plates being of non-magnetic material. At least one first magnet 16 is disposed in the first plate 12 for movement therewith, and at least one second magnet 18 is disposed in the second plate 14 for movement therewith. The first and second magnets 16, 18 are disposed in the first and second plates, 12, 14, respectively, adjacent the hinge axis 20.

As illustrated in FIG. 1, the magnets 16, 18 have a vertically oriented magnetic orientation with the bottom major face being north (N) and the top major face being south (S). Typically, the magnets 16, 18 are thin flat rectangles or squares (whether with right angle corners or corner radii). The magnets 16, 18 may be glued to the first and second plates 12, 14, respectively, for movement therewith. Where the plates 12, 14 are formed of a thermoplastic material, heat sealing, ultrasonic bonding or similar techniques may be used for securing together the plates and the magnets. While the first and second magnets 16, 18 are typically in immediate physical contact (either face-to-face in the closed orientation or end-to-end in the open orientation), the mechanics of heat welding or ultrasonic bonding may result in a slight separation of the first and second magnets (typically by no more than 0.5 mm), but the first and second magnets remain in essentially immediate physical contact.

Figure 2:
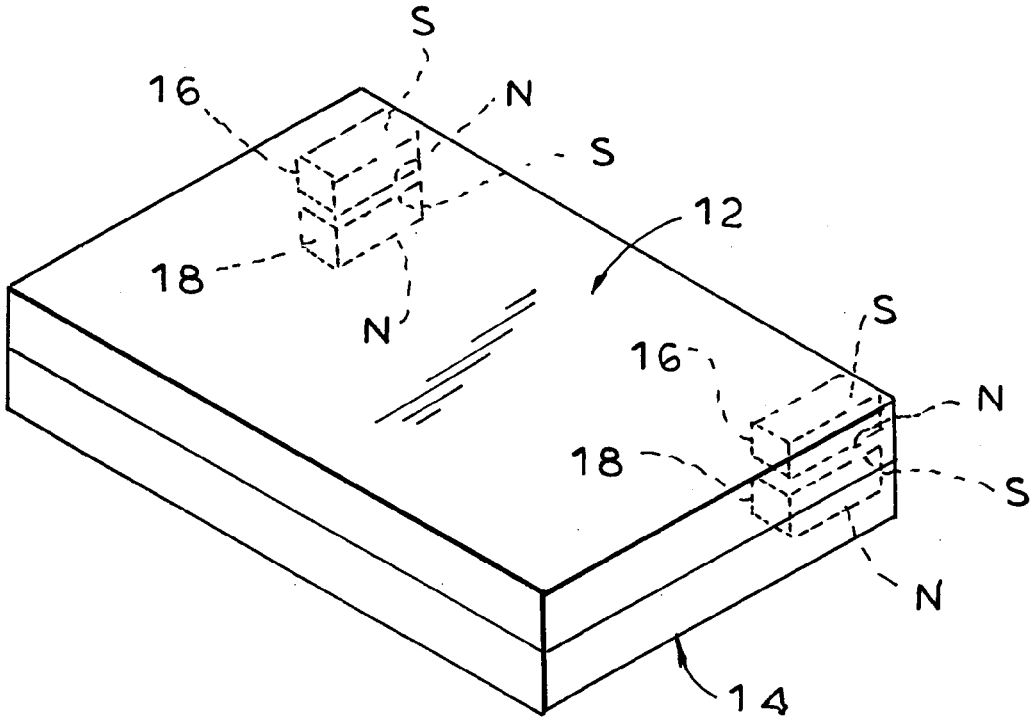
FIG. 2 is an isometric assembly view thereof in the closed orientation.
Figure 3:
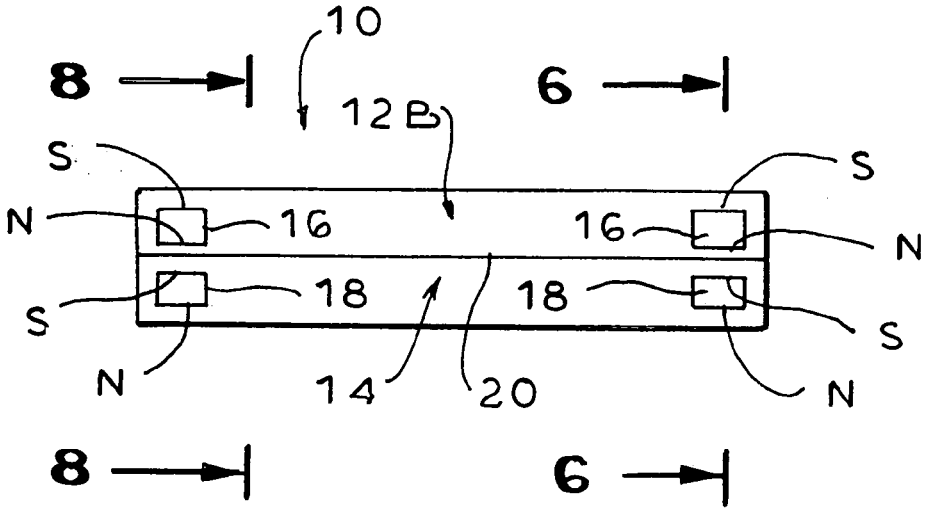
FIG. 3 is a back elevational view thereof in the closed orientation.
Figure 4:
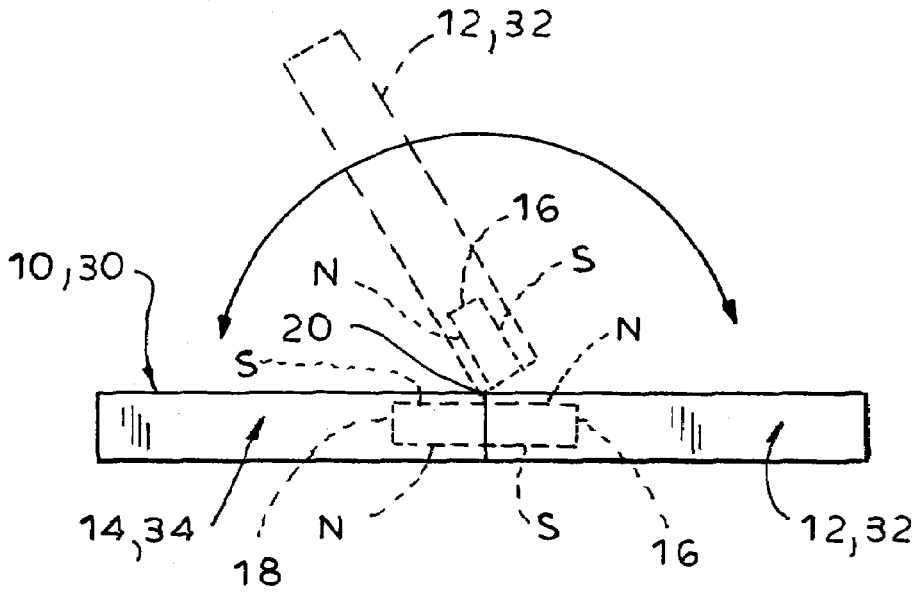
FIG. 4 is a side elevational view thereof in the open orientation, with one plate being shown in an intermediate orientation in phantom line.
Figure 5:
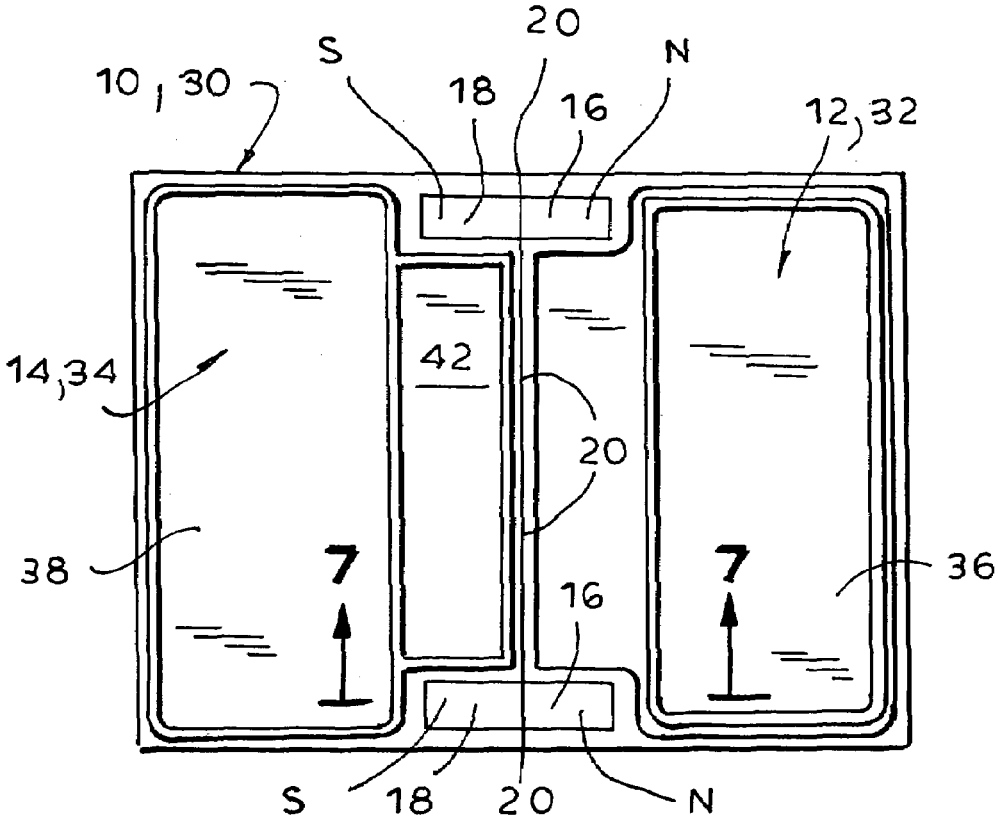
FIG. 5 is a top plan view thereof in the open orientation.
Figure 7:
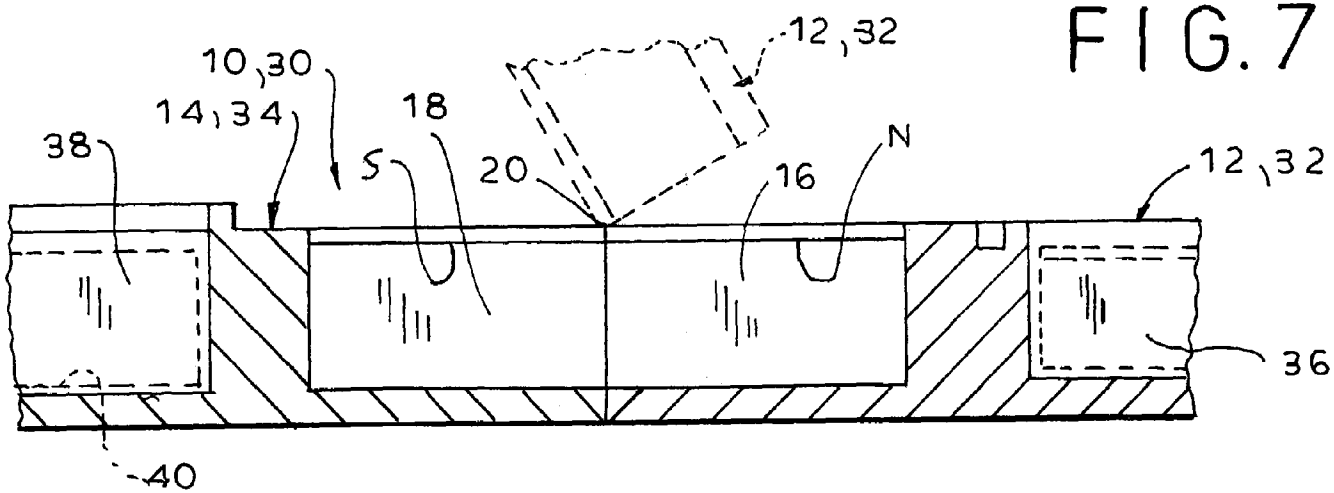

The first and second plates 12, 14 are movable about the hinge axis 20 between the closed orientation illustrated in FIGS. 2-3 and the open orientation illustrated in FIGS. 4-5. In the closed orientation of FIGS. 2-3, the first and second plates 12, 14 are generally parallel and at least partially overlapping, while the first and second magnets 16, 18 are generally parallel, overlapping and in the same magnetic orientation. In the open orientation of FIGS. 4-5, the first and second plates 12, 14 are generally parallel but at least partially non-overlapping, and the first and second magnets 16, 18 are generally parallel, but non-overlapping and in opposite magnetic orientations. In this open orientation, the first and second magnets 16, 18 are coplanar and aligned along a common axis.

The first plate 12 and the first magnet 16 are readily manually separable from the second plate 14 and the second magnet 18 to deconstruct the hinge 10. Thus, each plate 12, 14 may be removed from the vicinity of the other plate 14, 12 for separate use. The first plate 12 and the first magnet 16 are preferably more readily manually separable from the second plate 14 and the second magnet 18 to deconstruct the hinge when the plates 12, 14 are in the open orientation (than when the plates 12, 14 are in the closed orientation) and when the magnets 16, 18 are in an end-to-end orientation (than when the magnets 16, 18 are in face-to-face orientation). It will be appreciated, however, that this is not necessarily always the case. The first plate 12 and the first magnet 16 are readily manually joinable with the second plate 14 and the second magnet 18 to reconstitute or reconstruct the hinge 10 in either the closed or open orientation.

In a preferred configuration of the magnets 16, 18, each major face thereof is of greater area than an end thereof (the major faces being the top and bottom faces, as illustrated in the closed orientation of FIG. 1). Thus the magnetic attraction is stronger when the magnets are in the closed face-to-face orientation than when the magnets are in the open end-to-end orientation. Preferably, the magnets 16, 18 are relatively thin squares with the major faces thereof aligned with the plates 12, 14 in which they are disposed. In the closed orientation of FIGS. 2-3 wherein the first and second plates 12, 14 are generally disposed in two parallel planes, preferably the major faces of first and second magnets 16, 18 are closely adjacent (and optimally in contact) and superposed. (Where the first and second magnets 16, 18 are of common length and common width (that is, of the same planar dimensions), the term "superposed" is used to mean in complete vertical alignment and not just partially overlapping). In the open orientation of FIGS. 4-5 wherein the first and second plates 12, 14 are generally disposed in a common plane, the first and second magnets 16, 18 are closely adjacent (and optimally in contact) along a common axis. It will be appreciated that, because the facing end surfaces of the first and second magnets 16, 18 in the open orientation are of lesser area than the facing major faces of the first and second magnets 16, 18 in the closed orientation, magnets 16, 18, and hence the plates 12, 14, are more readily manually separable (that is, less force is required for separation) in the open orientation than in the closed orientation.

Referring now to FIG. 8 in particular, assuming that the first and second magnets 16, 18 are rectangular in outline, in essentially face-to-face contact in the closed orientation, and in essentially end-to-end contact in the open orientation, the first and second plates 12, 14 are pivotable about a virtual hinge axis 20 between the closed and open orientations, respectively. In the open orientation the virtual hinge axis 20 extends tangentially to and intermediate the tops of the contiguous rear edges of the first and second plates 12, 14.

Hinge embodiment 10 may be bistable if each of the first and second magnets 16, 18 is of appreciable thickness and has a major face and an end extending at a right angle to one another adjacent hinge axis 20, as illustrated. In the bistable hinge, each of the first and second magnets is preferably non-cylindrical, and optimally a rectangular parallelepiped. Alternatively, the hinge may be other than bistable if each of the first and second magnets extends in a smooth curve from the major face to the end adjacent the hinge axis. For example, if the first and second magnets are circular in cross-section (that is, if the magnets are cylindrical) and extend parallel and tangential to a common hinge axis, the hinge is non-stable. On the other hand, if the ends of the magnets facing the hinge axis in the open orientation are rounded, but the magnets still have major faces opposing one another in the closed orientation, the hinge may be monostable—that is, stable in the closed orientation only.

At least one of the first and second plates 12, 14 preferably incorporates means to preclude relative sliding movement of the plates 12, 14 parallel or transverse to the hinge axis 20 while the plates are in the closed orientation. As illustrated in FIGS. 1 and 5-7, in the closed orientation the bottom face of upper plate 12 has a downwardly extending peripheral projection 13 on the front and sides thereof and a part of the rear, and the top face of lower plate 14 has a downwardly opening peripheral groove or recess 15 on the front and sides thereof and a part of the rear. The projection 13 snugly mates with groove or recess 15 when the plates 12, 14 are in the closed orientation. This construction precludes not only relative sliding movement of the plates 12, 14 along or parallel to the hinge axis 20 when the plates are in the closed configuration, but also relative sliding movement of the plates 12, 14 transverse to the hinge axis 20.

In a preferred embodiment, the first plate 12 has disposed therein at least a spaced apart pair of first magnets 16, 16 adjacent to hinge axis 20 and the second plate 14 has disposed therein at least a spaced apart pair of second magnets 18, 18 adjacent to hinge axis 20. In the closed orientation, each of the first magnets 16, 16 is generally parallel to and overlapping a respective one of the second magnets 18, 18 and is in the same magnetic orientation with respect thereto. In the open orientation, each of the first magnets 16, 16 is generally parallel to and non-overlapping a respective one of the second magnets 18, 18 and in an opposite magnetic orientation with respect thereto. The provision of a plurality of first magnets 16 and second magnets 18 assists in definition of the virtual hinge axis 20 and thereby decreases the possibility of an unintended manual separation of the first and second plates 12, 14 during movement of the plates between the closed and open orientations.

Because the hinge pin is only virtual and not physical, the virtual hinge axis 20 does not increase the physical dimensions of the hinge 10 and the virtual hinge axis 20 does not physically occupy space immediate the hinge plates 12, 14. As the hinge axis 20 neither increases the physical dimensions of the hinge nor physically occupies space intermediate the hinge plates, the hinge can be extremely compact and allow maximum utilization of the space intermediate the plates.

The magnets 16, 18 are preferably of small size but significant strength and may be formed of alnico, neodymium (a rare-earth metal) or like materials of high magnetic flux.

The hinge 10 of the present invention may be incorporated in a wide variety of different consumer and industrial products. By way of example, the hinge 10 is illustrated in FIGS. 1 and 2 in the context of a modular hinge compact or cosmetic case, generally designated 30. One of the plates (here, upper plate 12) defines a cover 32 of the case 30, and the other of the plates (here, lower plate 14) defines a base 34 of the case 30, the base 34 and cover 32 being movable between closed and open orientations, as illustrated. Optionally, as best illustrated in FIG. 5, the cover 32 includes a mirror 36, and the base 34 includes a cosmetic 38 (such as a powder, base, lipstick, eyeshadow or the like) which may be applied while looking into the mirror 36 or "checked" thereafter by looking into the mirror 36. Conveniently, the cosmetic 38 is disposed in a removable pan 40 (see FIGS. 6 and 8) which is insertable into and removable from the base 34 with the cosmetic 38 therein as a unit. The pan 40 may be of metallic material, and the second magnets of the second plate 14 or base 34 may act to releasably maintain the pan 40 (and hence the cosmetic 38 therein) in place. The mirror 36 is preferably slightly recessed in the cover 32 so that it is not in contact with the cosmetic 38 in base 34. An appropriate recess or groove 42 may be provided in the base 34 for storage of a cosmetic applicator (such as a powder brush, eyeliner pencil, lipstick brush or the like). Where there are a pair of second magnets 18, 18 the applicator recess or groove 42 is conveniently disposed intermediate the second magnets 18, 18.

Because the cover 32 and base 34 of the compact 30 (i.e., first plate 12 and second plate 14 of hinge 10) may be manually readily separated from one another, the separated mirror-containing cover 32 may conveniently be leaned against a separate support ease of viewing while the user holds the base 34 and applies the cosmetic 38 therefrom. Of course, base 34 or the pan 40 may be divided to hold more than one cosmetic 38, and, indeed, the base 34 may be configured to hold a plurality of smaller pans rather than a single large pan 40. Where the pans 40 are releasably maintained in base 34, they are preferably easily replaceable to allow interchanging of different colored eye shadow or face powder combinations. Downwardly extending central rim or projection 44 of cover 32 and the upwardly opening central recess or groove 46 of base 34 cooperatively function—along with projection 13 and recess 15—to seal the cosmetic 38 within the compact 30 while the cover 32 and base 34 are in the closed orientation, thereby preventing escape of eye shadow, face powder, or the like from the closed compact 30. Rim 44 and groove 46 also cooperate with projection 13 and recess 15, respectively, to preclude relative sliding movement forward and rearward of the base 32 and cover 34.

A preferred compact case 30 according to the present invention may have dimensions as small as 2"×1¼"×⅜" with each of the two first magets 16, 16 and two second magnets 18, 18 being as small as ¼"×⅛"×⅛". No internal volume of the compact being wasted on a physical hinge pin. The cover and base are readily manually separable and readily manually reconstituted. The compact is bistable and possesses a relocatable hinge axis.

Figure 10:
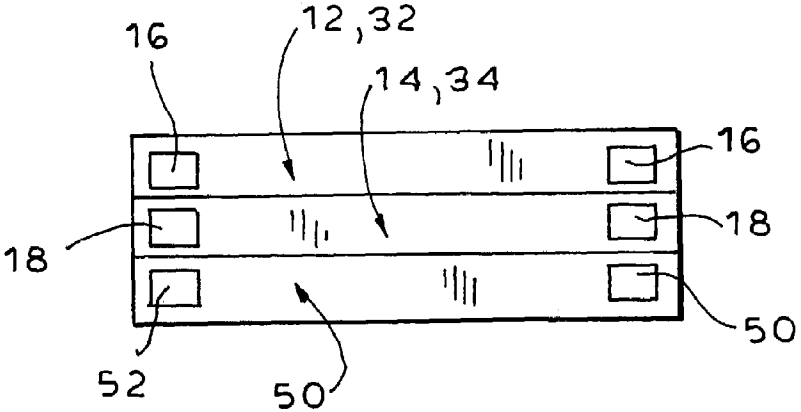
FIG. 10 is a rear elevational view thereof.
Figure 9:
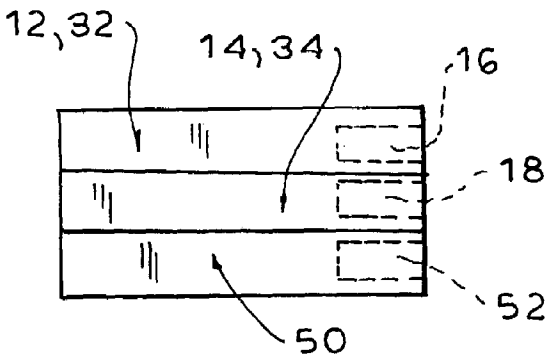
FIG. 9 is an end elevational view of a three plate hinge according to the present invention in a closed orientation.

Referring now to FIGS. 9-13, in the event that another compartment is desired for the compact 30, a third plate 50, as illustrated essentially identical to the base 34 (with or without a pan 40), may be added to the bottom of the compact 30, thereby increasing its thickness by ½ as best seen in FIGS. 9 and 10. The third plate 50 may be pivoted relative to the base 34 and separated from and/or reconstituted therewith.

Figure 11:
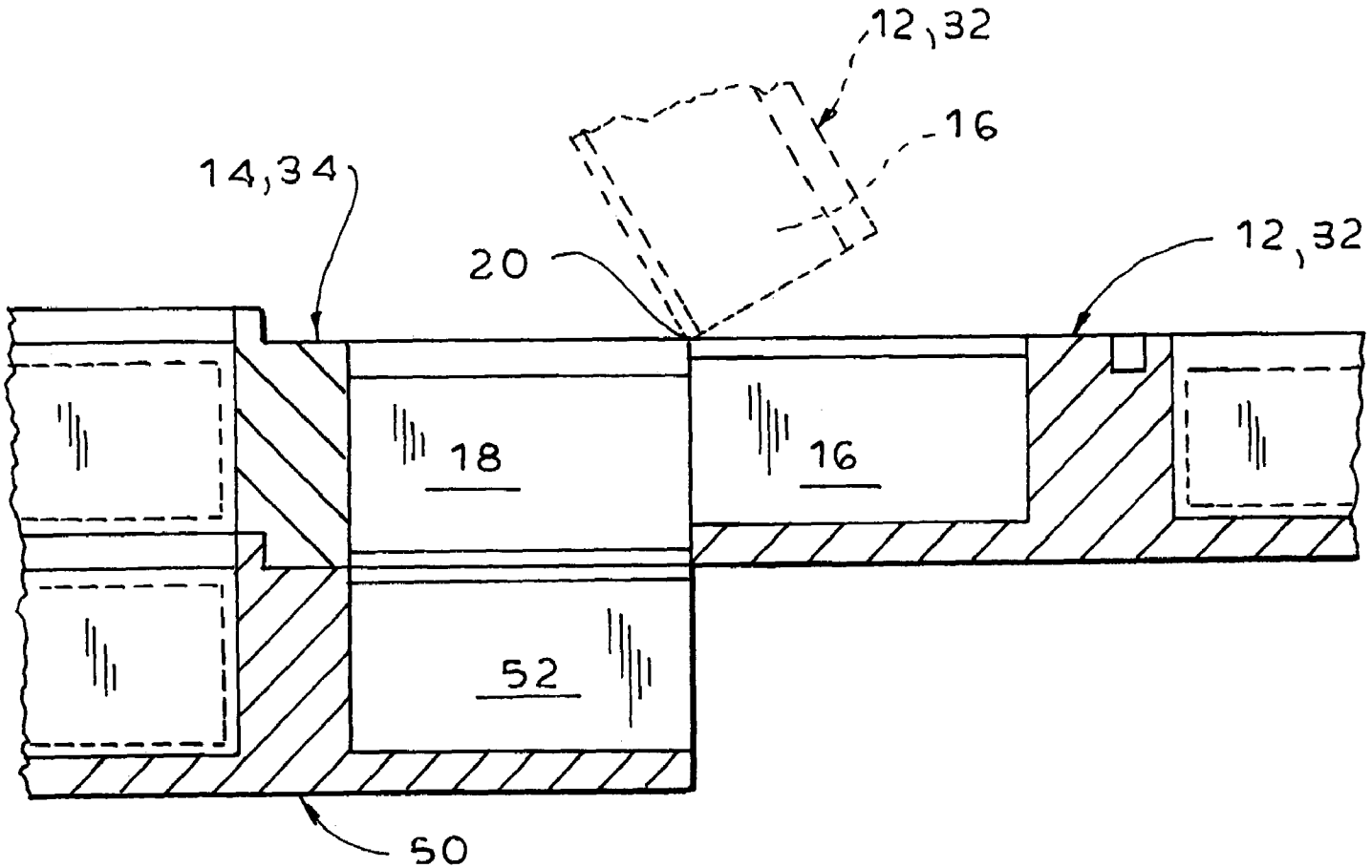
FIG. 11 is a fragmentary sectional view thereof with the first and second plates in an open end orientation and the second and third plates in a closed orientation, the first plate also being illustrated in phantom line in an intermediate orientation.

Referring now to FIG. 11 in particular, second and third plates 14, 50 may be pivoted as a unit relative to first plate 12, or vice versa, about a stationary virtual hinge axis 20 between the open and closed orientations. However, referring now to FIG. 12 in particular, when the third plate 50 is pivoted relative to the second plate 14 (or the first and second plates 12, 14, as a unit), or vice versa, the initial virtual hinge axis 20 relocates itself to a second virtual hinge axis 20'. Initial virtual hinge axis 20 is intermediate and tangential to second and third plates 14, 50 in the open orientation, with the upper major faces on the second and third plates horizontally aligned in a common plane; relocated virtual hinge axis 20' is still intermediate to the second and third plates 14, 50 in the open orientation, but now it is adjacent one major face (here, the upper major face of plate 50) but not the other major plate face (here, the upper major face of plate 14) since the two upper major faces are no longer horizontally aligned in a common plane, but rather somewhat vertically offset. (Instead, the magnets 18, 52 of second and third plates 14, 50 are horizontally aligned in a common plane.)

Figure 12:
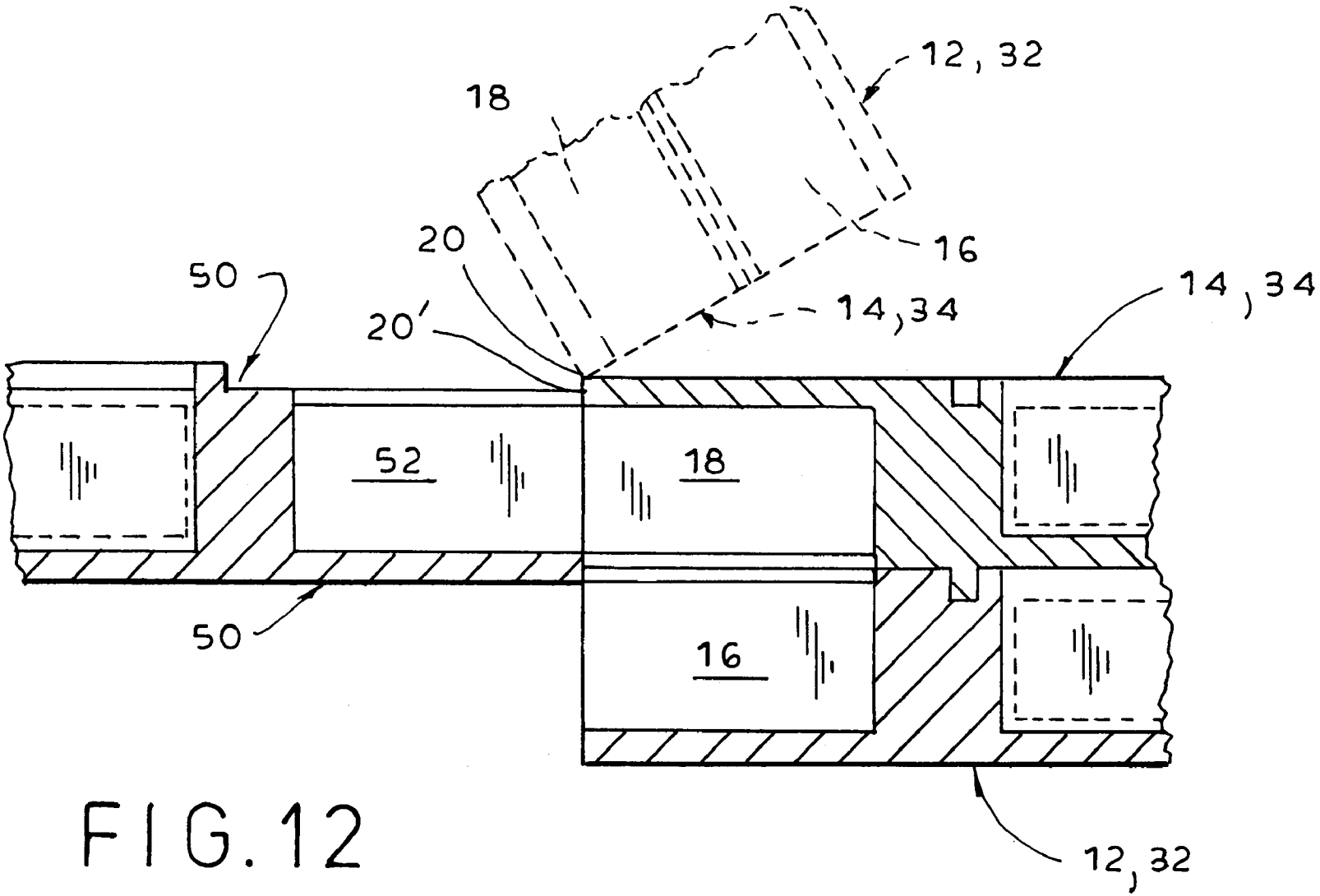
FIG. 12 is a fragmentary sectional view thereof with the first and second plates in a closed orientation and the second and third plates in an open orientation, with the first and second plates also being illustrated in phantom line in an intermediate orientation.

FIG. 12 illustrates movement of the first and second plates 12, 14 as a unit relative to third plate 50, or vice versa, so as to expose the contents of the third plate 50 for use.

Figure 13:
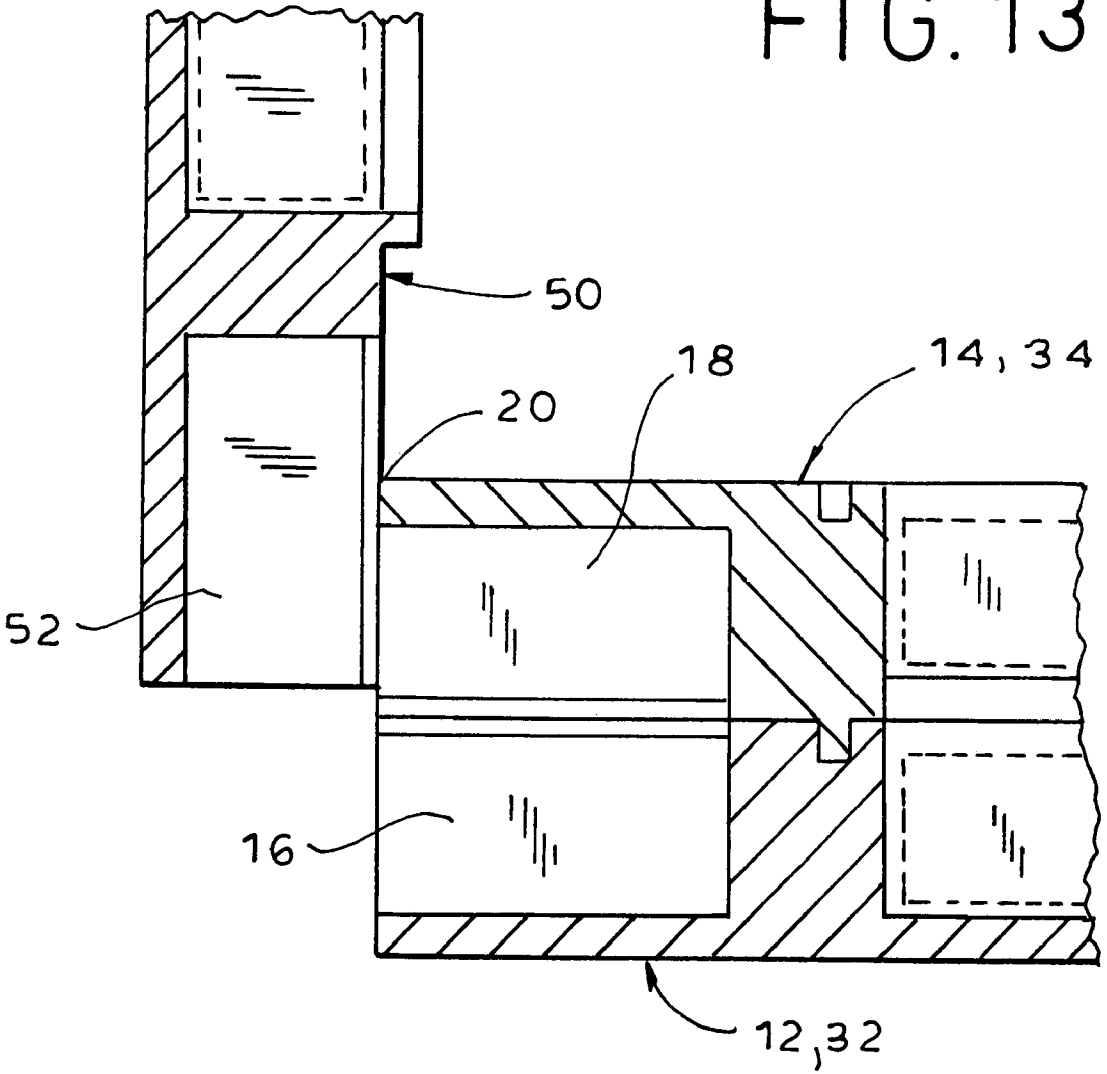
FIG. 13 is a fragmentary sectional view thereof with the first and second plates closed and the second and third plates open.

Referring now to FIG. 13 in particular, the third plate 50 is tri-stable—that is, it is stable not only in the closed orientation and open orientations relative to the base 34, but additionally in the single intermediate orientation of FIG. 13 wherein it is generally transverse (at a right angle) to the base 34. In this third stable orientation, the initial virtual hinge axis 20 between the base 34 and the third plate 50 relocates as the latter moves from the closed orientation to the stable intermediate orientation. This is because the base 34 is thicker than the second magnet 18 so that the second magnet 18 of base 34 and the magnet 52 of the third plate 50 are not in contact and are appreciably spaced apart when the third plate 50 is in a closed orientation with the base 34.

As one pivots the front of plate 50 from the closed orientation relative to a plate 14 held stationary, at some point the pivoting of the plate 50 about the hinge axis 20 will transition sharply from a smooth pivoting to a slight jerk as the hinge axis relocates relative to the plate 14 and the plate 50 jerks into the vertically offset stable intermediate orientation of FIG. 13. This vertical relocation of the hinge axis is, of course, possible only because the hinge is devoid of a physical hinge pin.

Should still further compartments be desired for the compact 30, additional components generally similar to third plate 50 or base 34 may be added as desired.

To summarize, the current invention provides a magnetic or virtual hinge characterized by a virtual hinge axis. The hinge has no hinge pin either to increase the physical dimensions of the hinge or occupy space intermediate the hinge plates. The hinge plates are readily manually separable to deconstruct the hinge and readily manually joinable to reconstitute the hinge. The hinge may be nonstable, monostable or bistable. The hinge axis may relocate as the hinge plates move between the closed and open orientations. Various devices may profitably incorporated such a hinge.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. A device comprising:

a first plate;

at least one first magnet associated with the first plate;

a first cosmetic product associated with the first plate;

a second plate;

at least one second magnet associated with the second plate; and a second cosmetic product associated with the second plate;

wherein the device is configured so as to permit stacking of the first and second plates together such that the first and second magnets magnetically attract the first plate and the second plate to one another;

wherein the device is configured so as to permit movement of the first plate with respect to the second plate between a first position in which the first plate covers the second plate to limit access to the second cosmetic product, and a second position in which access to the second cosmetic product is permitted; and wherein the device is configured so that the first and second magnets magnetically attract the first and second plates to one another in both the first position and the second position.

2. The device of claim 1, further comprising a pan, wherein the first cosmetic product is contained in the pan.

3. The device of claim 2, wherein the first magnet magnetically attracts the pan.

4. The device of claim 2, further comprising another pan, wherein the second cosmetic product is contained in the other pan.

5. The device of claim 1, wherein one of the plates comprises a recess for storage of a cosmetic applicator.

6. The device of claim 1, wherein the device is configured so as to permit stacking of the first and second plates in both a first stacked arrangement in which a bottom of the first plate contacts a top of the second plate, and a second stacked arrangement in which a top of the first plate contacts a bottom of the second plate, and wherein the first and second magnets magnetically attract the first and second plates to one another in both the first stacked arrangement and the second stacked arrangement.

7. The device of claim 1, further comprising a third plate and a mirror associated with the third plate.

8. The device of claim 7, wherein the mirror is on an inner face of the third plate.

9. The device of claim 1, wherein said movement comprises pivotal movement about a hinge axis.

10. The device of claim 9, wherein at least one of the plates comprises means for precluding relative sliding movement thereof parallel to the hinge axis.

11. The device of claim 9, wherein at least one of the plates comprises means for precluding relative sliding movement thereof transverse to the hinge axis.

12. The device of claim 9, wherein the hinge axis extends tangentially to the peripheries of the first and second plates in both the first and second positions.

13. The device of claim 9, wherein the device is configured so as to permit stacking of the first and second plates together in a stacking direction, and wherein the hinge axis is perpendicular to the stacking direction.

14. The device of claim 1, wherein, in the first position, the first and second plates are disposed in two parallel planes.

15. The device of claim 1, wherein, in the second position, the first and second plates are disposed in a common plane.

16. The device of claim 1, wherein the device is configured such that the first and second plates are movable about a hinge axis between a closed orientation wherein said first and second plates are generally parallel and at least partially overlapping, and an open orientation wherein said first and second plates are generally parallel and at least partially non-overlapping.

17. The device of claim 16, wherein the device is configured such that in the closed orientation the first and second magnets are generally parallel, overlapping and in the same magnetic orientation, and the device is configured such that in the open orientation the first and second magnets are generally parallel, non-overlapping, in opposite magnetic orientations, coplanar, and aligned along a common axis.

18. The device of claim 1, wherein the at least one first magnet comprises a pair of first magnets, and the at least one second magnet comprises a pair of second magnets.

19. The device of claim 1, wherein the device is configured so as to permit stacking of the first and second plates together in a stacking direction, and wherein the device is configured so as to permit relative pivotal movement of the first and second plates about an axis perpendicular to the stacking direction.

20. The device of claim 1, wherein the device comprises a magnetic hinge permitting pivotal movement of the first plate with respect to the second plate between the first and second positions, wherein the magnetic hinge comprises the first and second magnets, and wherein the first and second magnets magnetically attract the first and second plates to one another during pivotal movement of the first plate with respect to the second plate between the first and second positions.

21. The device of claim 1, further comprising a third plate and at least one third magnet associated with the third plate, wherein the device is configured so as to permit stacking of the first, second, and third plates together such that the first and second magnets magnetically attract the first and second plates to one another and the second and third magnets magnetically attract the second and third plates to one another.

22. The device of claim 21, wherein the first magnet is disposed in the first plate, the second magnet is disposed in the second plate, and the third magnet is disposed in the third plate.

23. A device comprising:

a first plate;

at least one first magnet associated with the first plate;

a second plate;

at least one second magnet associated with the second plate; and a cosmetic product associated with the second plate;

wherein the device is configured so as to permit stacking of the first and second plates in both a first stacked arrangement in which a bottom of the first plate faces a top of the second plate, and a second stacked arrangement in which a top of the first plate faces a bottom of the second plate; and wherein the first and second magnets magnetically attract the first and second plates to one another in both the first stacked arrangement and the second stacked arrangement.

24. The device of claim 23, further comprising a pan, wherein the cosmetic product is contained in the pan.

25. The device of claim 24, wherein the second magnet magnetically attracts the pan.

26. The device of claim 23, wherein one of the plates comprises a recess for storage of a cosmetic applicator.

27. The device of claim 23, further comprising a third plate and a mirror associated with the third plate.

28. The device of claim 27, wherein the mirror is on an inner face of the third plate.

29. The device of claim 23, wherein the device is configured so as to permit movement of the first plate with respect to the second plate between a first position in which the first plate covers the second plate to limit access to the cosmetic product, and a second position in which access to the cosmetic product is permitted, and wherein the device is configured so that the first and second magnets magnetically attract the first and second plates to one another in both the first position and the second position.

30. The device of claim 29, wherein said movement comprises pivotal movement about a hinge axis.

31. The device of claim 30, wherein at least one of the plates comprises means for precluding relative sliding movement thereof parallel to the hinge axis.

32. The device of claim 30, wherein at least one of the plates comprises means for precluding relative sliding movement thereof transverse to the hinge axis.

33. The device of claim 30, wherein the hinge axis extends tangentially to the peripheries of the first and second plates in both the first and second positions.

34. The device of claim 30, wherein the device is configured so as to permit stacking of the first and second plates together in a stacking direction, and wherein the hinge axis is perpendicular to the stacking direction.

35. The device of claim 29, wherein, in the first position, the first and second plates are disposed in two parallel planes.

36. The device of claim 29, wherein, in the second position, the first and second plates are disposed in a common plane.

37. The device of claim 23, wherein the device is configured such that the first and second plates are movable about a hinge axis between a closed orientation wherein said first and second plates are generally parallel and at least partially overlapping, and an open orientation wherein said first and second plates are generally parallel and at least partially non-overlapping.

38. The device of claim 37, wherein the device is configured such that in the closed orientation the first and second magnets are generally parallel, overlapping and in the same magnetic orientation, and the device is configured such that in the open orientation the first and second magnets are generally parallel, non-overlapping, in opposite magnetic orientations, coplanar, and aligned along a common axis.

39. The device of claim 23, wherein the at least one first magnet comprises a pair of first magnets, and the at least one second magnet comprises a pair of second magnets.

40. The device of claim 23, wherein the device is configured so as to permit stacking of the first and second plates together in a stacking direction, and wherein the device is configured so as to permit relative pivotal movement of the first and second plates about an axis perpendicular to the stacking direction.

41. The device of claim 23, wherein the device comprises a magnetic hinge permitting pivotal movement of the first plate with respect to the second plate between a first position in which the first plate covers the second plate to limit access to the cosmetic product and a second position in which access to the cosmetic product is permitted, wherein the magnetic hinge comprises the first and second magnets, and wherein the first and second magnets magnetically attract the first and second plates to one another during pivotal movement of the first plate with respect to the second plate between the first and second positions.

42. The device of claim 23, further comprising a third plate and at least one third magnet associated with the third plate, wherein the device is configured so as to permit stacking of the first, second, and third plates together such that the first and second magnets magnetically attract the first and second plates to one another and the second and third magnets magnetically attract the second and third plates to one another.

43. The device of claim 42, wherein the first magnet is disposed in the first plate, the second magnet is disposed in the second plate, and the third magnet is disposed in the third plate.

44. A device comprising:

a first plate;

at least one first magnet associated with the first plate;

a mirror associated with the first plate;

a second plate;

at least one second magnet associated with the second plate; and a cosmetic product associated with the second plate;

wherein the device is configured so as to permit movement of the first plate with respect to the second plate between a first position in which the first plate covers the second plate to limit access to the cosmetic product, and a second position in which access to the cosmetic product is permitted; and wherein the device is configured so that the first and second magnets magnetically attract the first and second plates to one another in both the first position and the second position.

45. The device of claim 44, further comprising a pan, wherein the cosmetic product is contained in the pan.

46. The device of claim 45, wherein the second magnet magnetically attracts the pan.

47. The device of claim 44, wherein the second plate comprises a recess for storage of a cosmetic applicator.

48. The device of claim 44, wherein the device is configured so as to permit stacking of the first and second plates in both a first stacked arrangement in which a bottom of the first plate contacts a top of the second plate, and a second stacked arrangement in which a top of the first plate contacts a bottom of the second plate, and wherein the first and second magnets magnetically attract the first and second plates to one another in both the first stacked arrangement and the second stacked arrangement.

49. The device of claim 44, wherein the mirror is on an inner face of the first plate.

50. The device of claim 44, wherein said movement comprises pivotal movement about a hinge axis.

51. The device of claim 50, wherein at least one of the plates comprises means for precluding relative sliding movement thereof parallel to the hinge axis.

52. The device of claim 50, wherein at least one of the plates comprises means for precluding relative sliding movement thereof transverse to the hinge axis.

53. The device of claim 50, wherein the hinge axis extends tangentially to the peripheries of the first and second plates in both the first and second positions.

54. The device of claim 50, wherein the device is configured so as to permit stacking of the first and second plates together in a stacking direction, and wherein the hinge axis is perpendicular to the stacking direction.

55. The device of claim 44, wherein, in the first position, the first and second plates are disposed in two parallel planes.

56. The device of claim 44, wherein, in the second position, the first and second plates are disposed in a common plane.

57. The device of claim 44, wherein in the first position the first and second plates are generally parallel and at least partially overlapping, and in the second position the first and second plates are generally parallel and at least partially non-overlapping.

58. The device of claim 57, wherein the device is configured such that in the first position the first and second magnets are generally parallel, overlapping and in the same magnetic orientation, and the device is configured such that in the second position the first and second magnets are generally parallel, non-overlapping, in opposite magnetic orientations, coplanar, and aligned along a common axis.

59. The device of claim 44, wherein the at least one first magnet comprises a pair of first magnets, and the at least one second magnet comprises a pair of second magnets.

60. The device of claim 59, wherein the device is configured such that the first and second plates are movable about a hinge axis between a closed orientation wherein said first and second plates are generally parallel and at least partially overlapping, and an open orientation wherein said first and second plates are generally parallel and at least partially non-overlapping.

61. The device of claim 60, wherein the device is configured such that in the closed orientation the first and second magnets are generally parallel, overlapping and in the same magnetic orientation, and the device is configured such that in the open orientation the first and second magnets are generally parallel, non-overlapping, in opposite magnetic orientations, coplanar, and aligned along a common axis.

62. The device of claim 44, wherein the device is configured so as to permit stacking of the first and second plates together in a stacking direction, and wherein the device is configured so as to permit relative pivotal movement of the first and second plates about an axis perpendicular to the stacking direction.

63. The device of claim 44, wherein the device is configured to permit pivotal movement of the first plate in a plane perpendicular to a plane defined by the second plate.

64. The device of claim 44, wherein the device comprises a magnetic hinge permitting pivotal movement of the first plate with respect to the second plate between the first and second positions, wherein the magnetic hinge comprises the first and second magnets, and wherein the first and second magnets magnetically attract the first and second plates to one another during pivotal movement of the first plate with respect to the second plate between the first and second positions.

65. The device of claim 44, further comprising a third plate and at least one third magnet associated with the third plate, wherein the device is configured so as to permit stacking of the first, second, and third plates together such that the first and second magnets magnetically attract the first and second plates to one another and the second and third magnets magnetically attract the second and third plates to one another.

66. The device of claim 65, wherein the first magnet is disposed in the first plate, the second magnet is disposed in the second plate, and the third magnet is disposed in the third plate.

* * * * *